United States Patent [19]

Consaga

[11] Patent Number: 4,944,815

[45] Date of Patent: Jul. 31, 1990

[54] BONDING AGENT FOR COMPOSITE PROPELLANTS

[75] Inventor: John P. Consaga, Waldorf, Md.

[73] Assignee: The United States of America as represented by the Secretary of the Navy, Washington, D.C.

[21] Appl. No.: 178,258

[22] Filed: Jul. 24, 1980

[51] Int. Cl.[5] ..... C06B 45/10

[52] U.S. Cl. ..... 149/19.1; 149/19.4; 149/19.6; 149/19.9; 149/19.91

[58] Field of Search ..... 149/19.1, 19.4, 19.6, 149/19.9, 19.91

[56] References Cited

U.S. PATENT DOCUMENTS

| | | | |
|---|---|---|---|
| 3,382,116 | 5/1968 | Gilman et al. | 149/19.4 |
| 3,609,115 | 9/1971 | Sommans et al. | 149/19.1 |
| 4,072,702 | 2/1978 | Huskins | 149/19.4 |
| 4,090,893 | 5/1978 | Cacksee et al. | 149/19.9 |
| 4,181,545 | 1/1980 | Anderson | 149/19.9 |
| 4,184,031 | 1/1980 | Graham et al. | 149/19.4 |
| 4,214,928 | 7/1980 | Consaga | 149/19.1 |
| 4,289,551 | 9/1981 | Perrault et al. | 149/19.4 |

*Primary Examiner*—Edward A. Miller

*Attorney, Agent, or Firm*—Kenneth E. Walden; Thomas McDonnell

[57] ABSTRACT

A universal bonding agent to improve binder-filler adhesion in composite propellants having the formula:

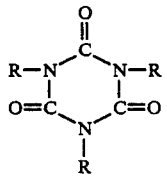

wherein R is

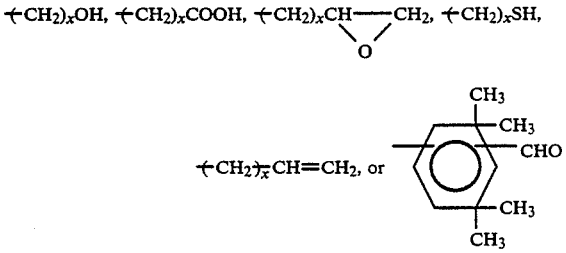

25 Claims, No Drawings

BONDING AGENT FOR COMPOSITE PROPELLANTS

BACKGROUND OF THE INVENTION

The invention pertains generally to composite propellants and in particular to strengthening composite propellants through a binder-filler interaction.

Composite propellants are nonhomogenous propellants and comprise primarily crystaline oxidizers and metal fuels uniformally suspended in a resin binder. The crystaline oxidizers are usually inorganic compounds, such as, ammonium perchlorate or potassium nitrate but can also be organic, for example, cyclotrimethylenetrinitramine (RDX) or cyclotetramethylenetetranitramine (HMX). The metal fuels are powders of elemental metals, such as, aluminum and magnesium. In contrast with these ingredients, the binders are organic polymers such as urethanes, polyamides or vinyl polymers. Often as much as 80 weight percent of the propellant is oxidizer along about 10 weight percent of metal fuel, thus, giving a solids loading of around 90 weight percent of the total composition.

The high solids loading requires an interaction between the binder and the filler in order to prevent dewetting, i.e., separation around a particle of filler. If dewetting occurs between the binder and filler, the flame front propagates below the burning surface to produce a more rapid combustion of the propellant. This development may lead to an over pressurization in the rocket motor, and/or higher burning rate slopes, and/or shorter action times, thus, resulting in a failure of the rocket motor specification. Another problem resulting from dewetting is that these separations or gaps act as focal points for crack propagation. Such a failure could easily cause detonation because of the sudden increase in burning surface area and the resulting increase in gas production. The gaps around oxidizer crystals can lead to blanching which results in crazing on the surface. Blanching adversely affects performance consistency.

A poor binder-filler interaction also causes problems for a missile in storage with time. If the motor is not sealed or if the seal leaks, moisture can more readily penetrate the propellant when dewetting has occurred. This can lead to a degradation of the binder, grain deformation and/or grain cracking when motors are temperature cycled. This problem is especially serious for nitramine oxidizers, such as, RDX and HMX. When these oxidizers degrade, nitrogen oxides are produced which catalyze cross-linking in the binders to produce an extremely stiff and brittle binder. With ammonium perchlorate (AP) oxidizers, moisture may dissolve the oxidizers to form an acid which also attacks the binders and/or cause the oxidizer to bloom or grow uncoated crystals on the bore. The resulting binder has a poor strength capability. The binder is not able to cycle to cold temperatures and the binder has a tendency to break down, causing a slump at the bore and thus a high pressure.

Poor interaction between binder and filler is found mostly with oxidizers and not with the metal fuels. The metals are not a problem because the metals have a more irregular surface and a greater ease for chemical bonding with the filler. On the other hand, oxidizers have surfaces which are very smooth, and in some cases the oxidizers do not chemically bond with the filler.

Attempts to improve the binder-filler interaction in composite propellants have included the addition of a re-inforcing agent, a wetting agent or a bonding agent. A re-inforcing agent increases the chemical and physical properties of the binder around the oxidizers, often producing hardened encasements for the oxidizer crystals. The disavantages of these agents are often a slight deteriation in the processability of the propellant and a minimal effect in reducing the problems caused by poor binder-filler intereaction. A wetting agent acts to wet the solids, thereby reducing the separations between the binder and filler. The improvement in binder quality when produced, is too slight to be of much consequence. A bonding agent produces an intereaction between the oxidizer crystal and the binder by forming either primary or secondary bonds with the oxidizer and a primary bond with the binder.

Since the ideal additive is a bonding agent, most research has been conducted on developing this additives, but due to the many requirements, few bonding agents have been developed. especially for HMX or RDX. In addition to forming a bond between the very chemically dissimilar crystal and binder, a bonding agent should also be chemically and thermally stable. A bonding agent should also be compatable with all oxidizers and binder systems. Preferably the bonding agent should also perform other functions, such as acting as a wetting agent or a scavanger for soluble metal impurities.

The presently used bonding agents, except for the bonding agent disclosed in U.S. patent application Ser. No. 745,519, filed 29 Nov. 1976 by John Consaga, are not universal bonding agents, that is, they can only be used for one or a few binder-filler systems but not for all binder-filler systems. One agent is N,N biscyanoethyl-2,3-dihydroxypropylamine. This agent cannot be used with nitramine oxidizers, and good results are only obtained with ammonium perchlorate systems. The binder systems in which this agent can be used are polyurethane systems with polyether and isocynate cures. With filler systems, such as the important hydroxyl-terminated polybutadiene binder, the bonding agent has compatibility and solubility problems. The performance of this agent in a polyurethane-AP system is barely adequate.

Another bonding agent is the addition product of tris[-(2-methyl) -aziridinyl]phosphine oxide and tartaric acid and adipic acid. This bonding agent is susceptable to moisture degradation and the bond is barely adequate. Furthermore, the addition adduct is polyfunctional and tends to homopolymerize on standing.

The bonding agent, bis[1-(2-methyl)-aziridinyl]benzene-1,3 dicarboxylic acid amide, has problems with moisture and poor bonding due to a lack of interaction with the binder network. In addition, this bonding agent can only be used for ammonium perchlorate oxidizers.

The only universal bonding agent is the one disclosed in the above patent application by John Consaga. The major difficulty with this bonding agent is the difficulty in processing the propellant at solid loadings of 88% and higher.

SUMMARY OF THE INVENTION

It is, therefore, an object of this invention to improve the bonding of solids in a composite propellant.

A further object of the present invention is to provide a universal bonding agent for composite propellants.

Another object of the present invention is to improve the stability of a propellant by the inclusion of a bonding agent which scavanges soluble metal impurities.

And an other object of the present invention is to increase the amount of solids in a composite propellant by improving the processibility of the propellant.

These and other objectives are achieved by the inclusion into a composite propellant of functionally substituted isocyanurate which forms bonds with the surface of the propellant's crystalline oxidizers and with the propellant's binder.

DETAILED DESCRIPTION OF THE INVENTION

The bonding agents of the present invention are represented by the formula:

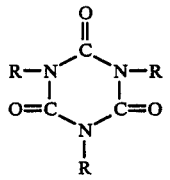

wherein R is

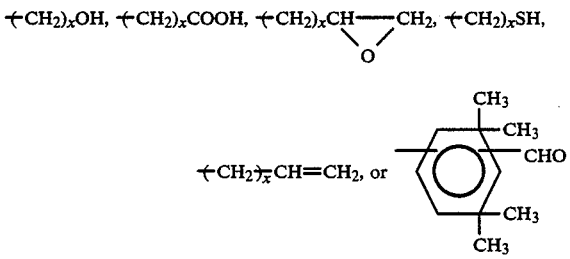

and x is from 2 to 5 with 2 or 3 preferred. Selection of a particular functional group is determined by the binder system, in that, the agent must chemically react with the binder. Thus the hydroxyl-, carboxyl-, and epoxy-terminated substituents would be selected for polyester or polyurethane binders; the vinyl substituent would be selected for vinyl polymers, e.g., polybutadine or polyisoprene., or mercaptyl-terminated substituent would be selected for polysulfide or polyester binders.

If the vinyl binder is functionally terminated, for example, epoxy, carboxyl, hydroxyl, mercaptyl, or episulfide terminated, the substituent would be selected which could react with the terminal function. For hydroxyl terminated polybutadiene, R can be a hydroxyl, epoxy or isocyanate terminated group. The same considerations would pertain to polyether binder systems, that is the epoxy or hydroxyl or mercaptyl terminating functions would control the selection of the substituent on the isocyanurate The bonding agents of the present invention are also universal as to oxidizers. They can be used with such common oxidizers as ammonium nitrate, potassium perchlorate, ammonium perchlorate, HMX, or RDX. Of particular importance is the effectiveness of the present bonding agents in a HMX-or RDX - hydroxyl terminated polybutadiene system.

The bonding agent is added in an effective amount, i.e., from about 0.10 weight percent to about 5 weight percent and generally from 0.15 to 1.0 percent based on total weight of propellant. The optimum amount is determined to a large degree on the relative amount of filler. In most of the currently used propellants, an amount from 0.15 to 0.3 would be the preferred amount.

Inclusion of the present bonding agent does not present any compatibility problems with any of the other ingredients found in composite propellants. The commonly used metals: aluminum, zirconium, magnesium, boron, lithium, and beryllium or metal hydrides: magnesium hydride, lithium aluminum hydride, boron hydride ($B_{10}H_{14}$), beryllium hydride ($BeH_2$) zirconium hydride, or aluminum hydride can be used as metal fuels in composite propellants containing the above bonding agents. Antioxidants, such as polyalkyl phosphited polyphenols, cyclic neopentane tetrayl bis(octadecyl phosphite), or 2,2'methylene bis(4-methyl-6-tertiary butyl phenol are compatible. Other frequently used ingredients which are suitable for compounding with the bonding agents include plasticizers such as dibutoxy bis oxyethyl adipate, epoxy curing agents such as N,N,2,3 diepoxypropyl-p-aminophenylglycidyl ether, or antiozinants such as cyclic neopentane tetrayl bis (ortadecyl phosphite). Ingredients such as a resin-curing catalyst, for example, ferric acetyl acetenate, (FeAA) cobalt naphthenate, or dibutyl tin dilaurate can be used with the bonding agents of the present invention. Since the present bonding agent also acts as a wetting agent, a surface active agent is not needed.

Propellant compounding proceeds in the usual manner. In other words, the inclusion of the subject bonding agents does not present any compounding problems. In fact, it helps compounding in that the bonding agents act as wetting agents.

In order to better illustrate the practice and the advantages of the present invention the following examples are given. It is understood that these examples are given by way of illustration and are not meant to limit this disclosure, or the claims to follow, in any manner.

EXPERIMENTAL SECTION I

Two AP-HTPB propellants were compounded identically except one had tris hydroxyisocyanurate and the other did not. A four cycle mixing process was used. In the first cycle, 435 grams of HTPB, 3 grams of ferric acetyl acetonate, 20 grams of di(stearyl pentacrythritol diphosphite, 20 grams of 2,2'methylene bis-(4-methyl-6-tertiary isophoronediisocyanate (IPDI), aluminum powder with a particle size of 50 microns in an amount of 40 grams, and 20 grams of graphite were added to a Baker-Perkins vertical mixer. In compounding the propellant with the subject bonding agent, 4 grams of tris hydroxyisocyanurate were added at this cycle. The mixture was degassed for about one hour, followed by a full vacuum for five minutes at 88° C. Powdered aluminum with a particle size of about 50 microns was added in an amount of 40 grams and was allowed to mix for 15 minutes with the last ten minutes under full vacuum at 60° C. In the third cycle 3,380 grams of an ammonium perchlorate blend with two particle sizes of about 200 and about 11 microns were slowly added over a period of ½ hour, followed by 5 minutes of full vacuum and a one hour mix at 60° C. The last cycle comprised adding 61 grams of isophoronediisocyanate (IPDI) and 20 grams of 1,3-bis(4-hydroxybutyl) tetramethyldisiloxane (TMDS) and mixing from 45 to 60 minutes under vacuum. The propellant was cured at 77° F. for 5 days at 60° C.

EXPERIMENTAL SECTION II

The effectiness of tris hydroxyisocyanurate as a bonding agent was determined by a comparison of the mechanical property data, scanning electron-microscopy study, and results from two other tests of the above propellants. The other two tests were the finger test which consists of manually rubbing the propellant surface to see if the oxidizer falls out and the needle test which consists of trying to remove oxidizers crystals with a needle without fracturing the crystal. If the oxidizer fell out and crystals could easily be picked out with a needle from the propellant, poor binder filler interaction had taken place. However, if oxidizer particles could not be rubbed out and the crystals fractured when picked out with a needle, the bonding agent was functioning properly.

Table 1 summarizes the mechanical property data of the two propellants. The results of the finger test and needle test were that the inclusion of tris hydroxyiscocyanurate prevented the oxidizers from being rubbed out of the propellant binder and prevented the oxidizer from being removed from the binder without fracture. The propellant without tris hydroxyisocyanurate had opposite results. Scanning electron photographs of the propellant showed that the formulation with no bonding agent had spaces around the crystals, smooth crators, a lack of stringy beads of polymer, and no fractured crystals. Whereas, the scanning electron photomicrographs for the propellant with tris hydroxyisocyanurate had fractured crystals, irregular shaped crators, stringy beads of polymer, and no spaces around the crystals.

TABLE 1

| | Sm(psi) | Em (%) | SR(psi) | Er (%) | Ym(psi) |
|---|---|---|---|---|---|
| No Bonding Agent | | | | | |
| −65° F. | 856 | 14 | 539 | 29 | 11848 |
| 77° F. | 99 | 26 | 82 | 40 | 742 |
| 165° F. | 86 | 24 | 80 | 28 | 583 |
| .15% THEI C | | | | | |
| −70 | 469 | 8 | 429 | 10 | 10004 |
| 77 | 183 | 10 | 180 | 10 | 2882 |
| 140 | 156 | 9 | 156 | 9 | 2417 |

EXPERIMENTAL SECTION III

Two additional propellants, HMXCTBN propellant and an AP-HTPB propellant, were compounded with a bonding agent.

A ten-cycle mixing process was used to compound the HMX-CTBN propellant. In the first cycle, 165 grams of carboxylterminated butadiene-acrylonitrile copolymer (CTBN), 9 grams of Vanox 13 (a polyalkyl phosphited polyphenol sold by Vanderbilt Corp.), 15 grams of graphite, 6 grams of lecithin, 18 grams of dibutoxy bis oxyethyl adipate (TP-95), and 8.1 grams of N,N',N''-tris(2,3 epoxypropyl)isocyanurate were added to a Baker-Perkins vertical mixer and were mixed at 88° C for 30 minutes at full vacuum. Next 147.2 grams of HMX (4μ) and 62.6 grams of HMX (15μ) were added and mixed for five minutes with no vacuum and for five minutes with full vacuum. This cycle was repeated five more times, adding, in total, 883.4 grams of HMX (4μ) and 375.7 grams of HMX (15μ) to the mix. In the next cycle of five minutes mixing at zero vacuum followed by ten minutes mixing at full vacuum, N,N,2,3 diepoxypropyl-p-amino phenylglycidyl ether (ERL0510) was added. Stannous octoate (0.9grams) was added during a mix cycle of five minutes at zero vacuum followed by a mixing for ten minutes at full vacuum. The last cycle comprised a 15-minute mix at full vacuum. The temperature of all of the cycles except the first was 66° C.

A nine-cycle mixing process was used to compound the AP-HTPB propellant. In the first cycle, 227 grams of hydroxy-terminated polybutadiene, 2 grams of cyclic neopentane tetrayl bis(octadecyl phosphate), 2 grams of 2,2'methylene bis(4-methyl-6-tertiarybutylphenol), 80 grams of dioctyl adipate, and 0.032 grams of ferric acetalacetonate were added to a Baker-Perkins vertical mixer and were mixed at 88° C for 30 minutes at full vacuum. Powdered aluminium (880 grams) was added in the second cycle of five minutes mixing under zero vacuum, followed by ten minutes mixing under full vacuum. The temperature was maintained at 88° C during the cycle. In the next two cycles of five minutes mixing under zero vacuum, speed, 529 grams of ammonium perchlorate (24 ) and 1680 grams of ammonium perchlorate (200μ) were added in 50 percent increments. The temperature was reduced to 60° and was maintained at that temperature for the rest of the compounding. In the fifth cycle 49 grams tris isocyanato isocyanurate of isophorone diisocyanurate (IPDI-T 1890M from Chemische Werke Huls AG) were added and were mixed for five minutes under zero vacuum. Next HMX (3.2,μ) in an amount of 560 grams was added in 33.33% increments during two cycles of five minutes mixing under zero vacuum, followed by 15 minutes mixing under full vacuum and one cycle of five minutes mixing under zero vacuum. A final mix cycle of 30 minutes under full vacuum finished the compounding.

Both propellants were cured at 77° C for five days.

EXPERIMENTAL SECTION IV

The effectiveness of the bonding agents, the isocyanateterminated isocyanurate (IPDI-T-1890M) and the epoxy-terminated isocyanurate (PT-810), was determined by scanning electron-microscopy studies, the finger test, and the needle test. Scanning election photographs of the propellants of Section III showed that the propellants had fractured crystals, irregular-shaped crators, stringy beads of polymer, and no spaces around the crystals. The results of the finger and needle tests were that the bonding agents prevented the oxidizers from being rubbed out of the propellant binder and prevented the oxidizer from being removed from the binder without fracture.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. In a composite propellant, the improvement comprising the inclusion, in an effective amount, of a bonding agent represented by the formula:

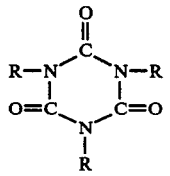

wherein R is selected from the class consisting of $(CH_2)_xOH$, $\leftarrow CH_2)_xCOOH$, $\leftarrow CH_2)_x-CH\overset{\diagup}{\underset{\diagdown}{O}}CH$, $\leftarrow CH_2)_xSH$, $\leftarrow CH_2)_x-CH=CH_2$, and

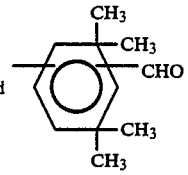

and x is from 1 to 5.

2. The composite propellant of claim 1 wherein the bonding agent is added in an amount of from about 0.10 to about 5.0 percent of the total propellant weight.

3. The composite propellant of claim 2 wherein the bonding agent is added in an amount of from 0.15 to 1.0 percent of the total propellant weight.

4. The composite propellant of claim 3 wherein the bonding agent is added in an amount of from 0.15 to 0.30 percent of the total propellant weight.

5. The composite propellant of claim 2, 3, or 4 wherein X is 2 or 3.

6. The composite propellant of claim 1 wherein R is $-(CH_2)_xOH$.

7. The composite propellant of claim 6 wherein the bonding agent is added in an amount of from about 0.10 to about 5.0 percent of the total propellant weight.

8. The composite propellant of claim 7 wherein the bonding agent is added in an amount of from 0.15 to 1.0 percent of the total propellant weight.

9. The composite propellant of claim 8 wherein the bonding agent is added in an amount of from 0.15 to 0.30 percent of the total propellant weight.

10. The composite propellant of claim 6, 7, 8, or 9 wherein x is 2 or 3.

11. The composite propellant of claim 1 wherein R is $-(CH_2)_xCOOH$.

12. The composite propellant of claim 11 wherein the bonding agent is added in an amount of from about 0.10 to about 5.0 percent of the total propellant weight.

13. The composite propellant of claim 12 wherein the bonding agent added in an amount of from 0.15 to 0.30 percent of the total propellant weight.

14. The composite propellant of claim 13 wherein the bonding agent in an amount of from 0.15 to 0.30 percent of the total propellant weight.

15. The composite propellant of claim 11, 12, 13, or 14 wherein x is 2 or 3.

16. The composite propellant of claim 1 wherein R is $-(CH_2)_xSH$.

17. The composite propellant of claim 16 wherein the bonding agent is added in an amount of from about 0.10 to about 5.0 percent of the total propellant weight.

18. The composite propellant of claim 17 wherein the bonding agent is added in an amount of from 0.15 to 1.0 percent of the total propellant weight.

19. The composite propellant of claim 18 wherein the bonding agent is added in an amount of from 0.15 to 0.30 percent of the total propellant weight.

20. The composite propellant of claim 16, 17, 18, or 19 wherein x is 2 or 3.

21. The composite propellant of claim 1 wherein R is $-(CH_2)_xCH\overset{\diagup}{\underset{\diagdown}{O}}CH_2$

22. The composite propellant of claim 21 wherein the bonding agent is added in an amount of from about 0.10 to about 5.0 percent of the total propellant weight.

23. The composite propellant of claim 22 wherein the bonding agent is added in an amount of from 0.15 to 1.0 percent of the total propellant weight.

24. The composite propellant of claim 23 wherein the bonding agent is added in an amount of from 0.15 to 0.30 percent of the total propellant weight.

25. The composite propellant of claim 21, 22, 23, or 24 wherein x is 2 or 3.

* * * * *